United States Patent [19]

Holman

[11] Patent Number: 4,520,872

[45] Date of Patent: Jun. 4, 1985

[54] EMERGENCY FIREHOSE SWITCHOVER DEVICE FOR WELLS AND THE LIKE

[76] Inventor: Ardee R. Holman, Box 1210, Wasillia, Ak. 99687

[21] Appl. No.: 527,491

[22] Filed: Aug. 29, 1983

[51] Int. Cl.[3] ..... A62C 35/00

[52] U.S. Cl. ..... 169/54; 137/355.27; 169/18

[58] Field of Search ..... 169/54, 57, 5, 16, 18; 137/355.16, 355.26, 355.27, 357

[56] References Cited

U.S. PATENT DOCUMENTS

| | | | |
|---|---|---|---|
| 2,752,198 | 6/1956 | Crow | 137/355.26 |
| 3,294,105 | 12/1966 | Schaub | 137/118 X |
| 4,361,189 | 11/1982 | Adams | 169/16 |

*Primary Examiner*—Jeffrey V. Nase
*Assistant Examiner*—Daniel R. Edelbrock
*Attorney, Agent, or Firm*—Shlesinger, Arkwright, Garvey & Fado

[57] ABSTRACT

An emergency fluid supply system in combination with a well having an electrically operable pump supplying fluid to a structure having a first fluid distribution system, an electric power supply and an electric distribution system includes a second fluid distribution system in fluid communication with the pump. A valve connects the first and second distribution systems and has a first position associated with supplying fluid to the first fluid distribution system and a second position associated with supplying fluid to the second fluid distribution system. A switch is in electrical connection with the electric power supply, the pump and the electric distribution system and has a first position associated with supplying power to the pump and the electric distribution system and a second position associated with supplying power to the pump only. The valve first position is associated with the switch first position and the valve second position is associated with the switch second position. An actuator assembly operably interconnects the valve and the switch for simultaneously positioning the valve and the switch in a preselected one of the first and second positions.

14 Claims, 3 Drawing Figures

FIG 2
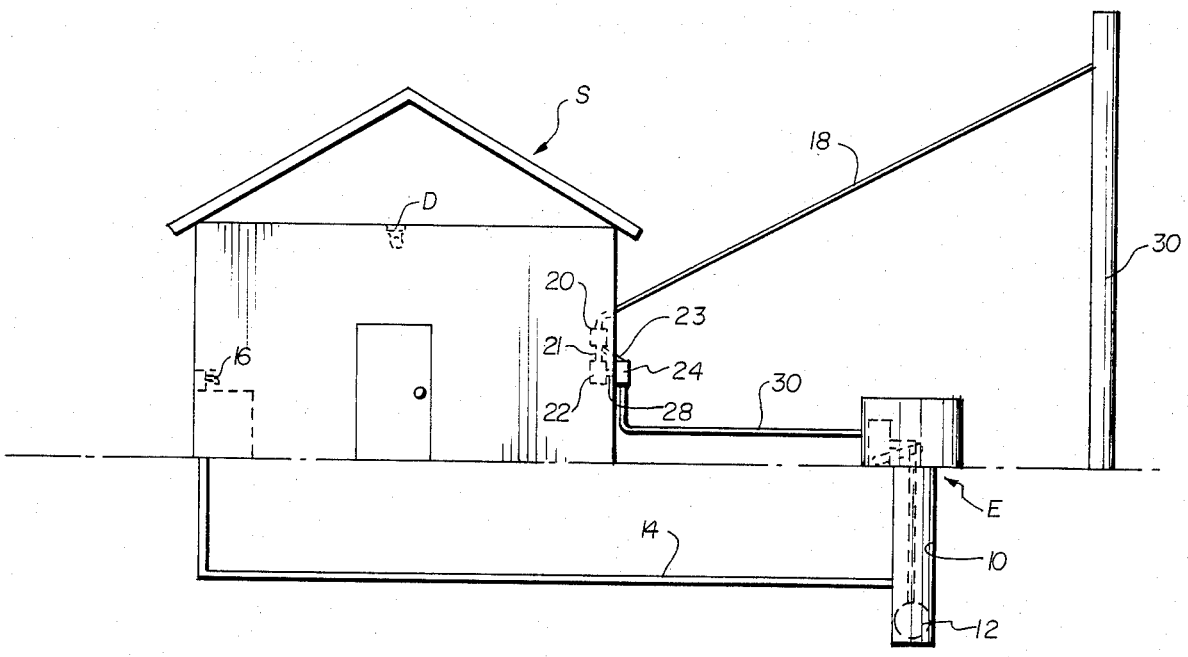
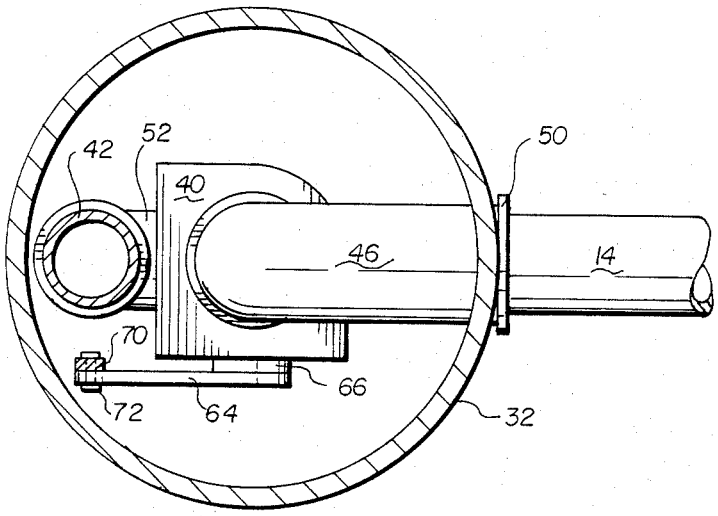
FIG 3

EMERGENCY FIREHOSE SWITCHOVER DEVICE FOR WELLS AND THE LIKE

BACKGROUND OF THE INVENTION

Many areas of the country, particularly rural areas, do not have the benefit of a municipial potable water supply system or of a firefighting water supply system. Persons living in these areas are required to obtain their water, both potable and firefighting, from subterranean wells which pump water from underground water sources to above ground. It is necessary that the subterranean wells supply all water requirements, including firefighting water, as the fire department may be too remote to be effective or be incapable of transporting sufficient supplies of water. Consequently, it is frequently the responsibility of the affected individual to use his own well to fight a fire burning on his property, as well as to supply his own drinking water.

A fire in an individual's home in one of these areas requires that the electric power be disconnected in order to prevent short circuiting and/or electrocution. Unfortunately, the pump in the well, which supplies water for the firefighting apparatus, is usually operated by the electric power supplied to the house. Consequently, when the electric power is turned off to prevent short circuiting and/or electrocution, the power to the pump is also turned off with the result that the house or other building will be destroyed because of an inability to supply water to fight the fire.

In view of the above problems, an emergency switchover system for turning off the electric power supplied to the house while supplying electric power to operate the pump is necessary. Such a system would allow a home owner to fight a conflagaration while still being able to prevent short circuiting and/or electrocution in the home or other building. Additionally, the system must provide a means for diverting the pumped water from the house to a fire hydrant.

Schaub, U.S. Pat. No. 3,294,105, discloses a combination domestic and firewater pumping system but does not provide a mechanism for turning off the electric power to the house while permitting the pump to operate.

Donohue, U.S. Pat. No. 1,866,253, describes a system for shutting off the supply of natural gas feeding a house from a gas main while simultaneously operating a sprinkler system or an alarm upon detection of fire.

In view of the limitations of the above described systems for solving the problem of the present invention, a new and original means for turning off the house power supply while simultaneously permitting operation of the well pump is necessary. The present invention describes and claims an emergency firehose switchover system for use with a well which solves the above identified problems and avoids the limitations of the above described systems.

OBJECTS AND SUMMARY OF THE INVENTION

It is a primary object of the disclosed invention to provide an emergency firehose shut-off system for turning off the electric power supplied to a structure while simultaneously providing power to a well pump and operating a valve for diverting pumped water to the firehose.

It is an additional object of the disclosed invention to provide a three-pole lever operated switch for supplying power to the pump while simultaneously shutting off the power supply to the structure.

Still another object of the disclosed invention is to provide a diverting valve which is in operable connection with the emergency switchover system for diverting pumped water from supplying the house to supplying the firehose apparatus.

Yet another object of the disclosed invention is to provide an emergency fire hose changeover system in which the diverter valve is located in the well.

Yet an additional object of the disclosed invention is to provide an emergency firehose changeover system in which the firehose is mounted to a rotatable wheel and is maintained in fluid communication with the pump.

Still another object of the disclosed invention is to provide an emergency firehose changeover system having a structure power supply system and an emergency power supply system for supplying power to the well pump.

Yet another object of the disclosed invention is to provide an emergency firehose changeover system in which the well and the firehose assembly are housed in a readily opened structure to prevent freezing and damage to the firehose and well.

Still yet a further object of the disclosed invention is to provide an emergency firehose changeover system having a first fluid supply system for supplying pumped water to a structure and having an interconnected second fluid distribution system for supplying water to a firefighting system.

Still yet a further object of the disclosed invention is to provide an interconnected electric changeover means and a valve diverter means which are remote from the building structure to be protected.

These and other objects and advantages of the invention will be readily apparent in view of the following description and drawings of the above described invention.

DESCRIPTION OF THE DRAWINGS

The above and other objects and advantages and novel features of the present invention will become apparent from the following detailed description of the preferred embodiment of the invention illustrated in the accompanying drawings, wherein:

FIG. 2 is a schematic with portions broken away and portions shown in phantom lines of the emergency firehose changeover system of FIG. 1 and disclosing a building structure and power supply means; and, FIG. 3 is a fragmentary cross-sectional view taken along the Section 3—3 of FIG. 1 and viewed in the direction of the arrows.

DESCRIPTION OF THE INVENTION

Figure 1:
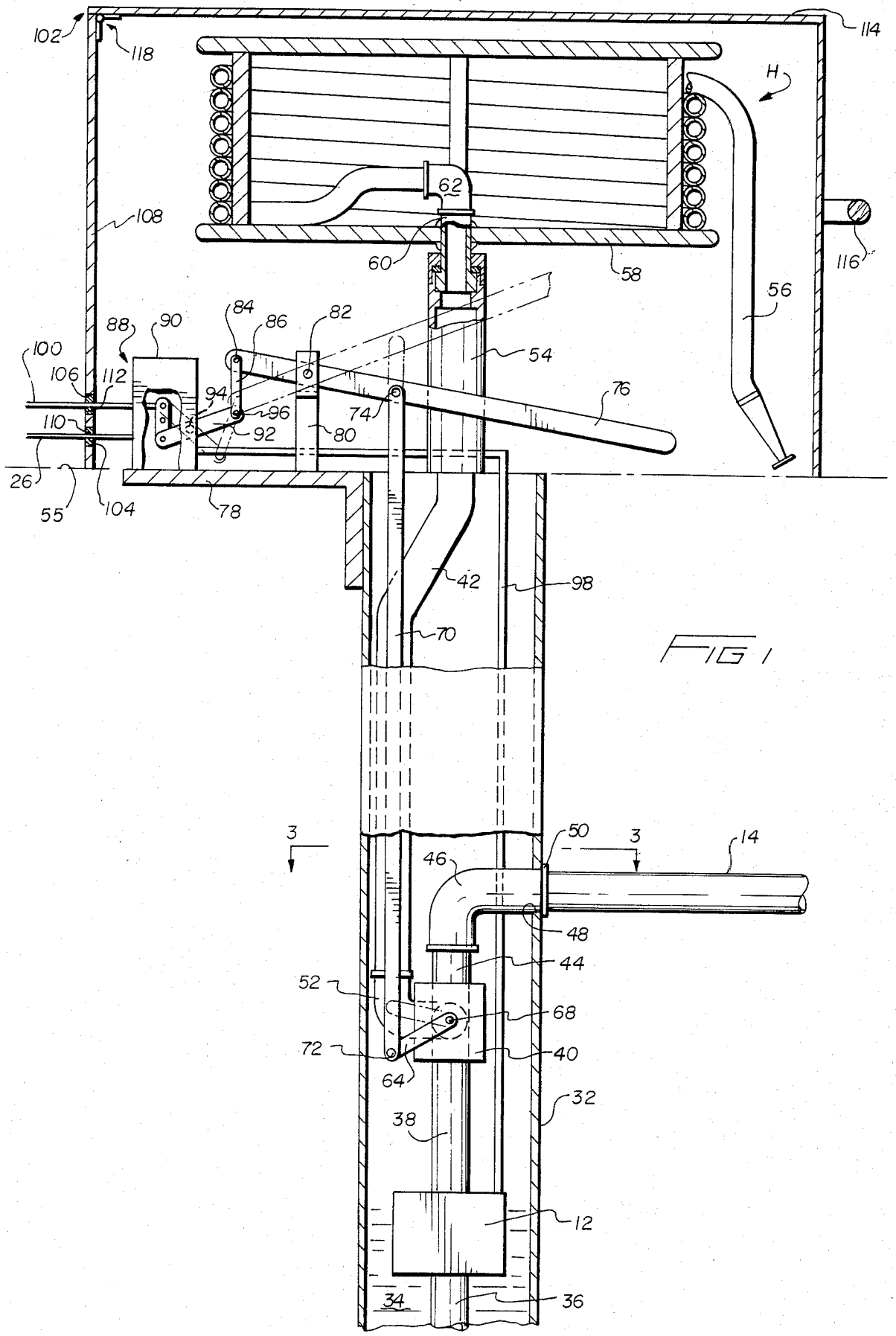
FIG. 1 is a fragmentary cross-sectional view with portions broken away and with phantom lines showing movement of parts of the emergency firehose changeover system of the present invention.

An emergency firehose changeover system E, as best shown in FIG. 2, includes a subterranean well 10 and a pump 12, both of which are, preferably, remote from structure S. Structure S is not limited to a house but may include any type of structure. The pump 12 is in fluid communication with structure S by means of pipe or first fluid distribution system 14. Fluid distribution system 14 may feed a faucet 16 or any other user of water, as is well known in the art.

An electric power supply or electric cable system 18 supplies power to an electric distribution system D in structure S, as is well known in the art. Electric power supply means 18 generally supplies power first to a meter 20, as is well known in the art, and the meter feeds power through cable 21 to power supply box 22 which is in electrical communication with electric distribution system D, as is well known in the art. Additionally, meter 20 is also adapted to feed through cable 23. An electrical power supply cable 26, as best shown in FIG. 1, preferably is disposed in conduit 28 which is in communication with emergency power supply box 24 and extends through conduit 30, as best shown in FIG. 2, which supplies emergency firehose changeover system E. In this way the normal house power supply which feeds electric distribution system D is also capable of providing house power to operate pump 12 so as to pump water through first fluid distribution system 14 to faucet 16. Generally, power supply means 18 includes a system of electric cables and poles 30 which are connected to a cource of electric power (not shown). It should be obvious that a portable electric generator, a battery system, or some other means of supplying electric power to power supply means 18 could be used in place of the conventional wire and pole means of supplying power to a house.

As best shown in FIG. 1, well casing 32 is disposed in well 10. Pump 12 is disposed within casing 32 and is preferably substantially submerged in and in fluid communication with water or other fluid 34 which fills well 10. Pump 12 may include pipe 36 which extends from pump 12 some distance into water 34. A riser pipe 38 extends upwardly from pump 12 and three-way valve 40 is disposed on pipe 38 and is in fluid communication with first fluid distribution system 14 and second fluid distribution system 42. Pipe 44 extends from valve 40 and is connected to elbow 46 which passes through casing 32 and is connected to first fluid distribution system 14. Preferably, aperture 48 in casing 32 from which elbow 46 extends is sealed by seal 50 circumferentially mounted about pipe 14 of first fluid distribution system 14 to prevent entry of dirt or other material into well 10.

Elbow 52 is in fluid communication with valve 40 and connected to pipe or second fluid distribution system 42. Pipe or second fluid distribution system 42 extends upwardly to, preferably, at least ground level 55 and feeds riser 54. A reel operated hydrant H, substantially as known from Clay, U.S. Pat. No. 933,290, is mounted to riser 54. Reel operated hydrant H includes coiled firehose 56 which is mounted to reel 58 which is rotatable on pipe 60. Elbow 62 connects pipe 60 to hose 56. In this way, reel operated hydrant H permits firehose 56 to be withdrawn by rotation of reel 58 while still permitting hose 56 to be in fluid communication with pump 12.

Valve 40 is a three-way valve and has a first position shown in dark lines in FIG. 1 associated with supplying water to pipe or first fluid distribution system 14. Valve 40 has a second position, as best shown in phantom lines in FIG. 1, which is associated with supplying water to reel operated H by means of pipe or second fluid distribution system 42. Valve 40, as best shown in FIGS. 1 and 3, is operated by lever 64 which is operably connected to valve 40 by means of shaft 66 pinned by pin 68 to lever 64. Lever 64 is rotationally disposable so as to move valve 40 from the first position associated with supplying fluid to first fluid distribution system 14 to second fluid distribution system 42. Link or rod 70 has one end pinned by pin 72 to lever 64 and the other end pinned by pin 74 to pivotable lever 76 which is disposed above well 10, preferable above surface 55.

Platform 78 is mounted, preferably substantially at ground level 55 and adjacent well casing 32. Support 80 extends upwardly from platform 78 and is pinned by pin 82 to lever 76. Preferably support 80 is disposed toward one end of lever 76 substantially midway between pin 74 and pin 84 to which link 86 is connected.

Three-pole electric switch 88 is disposed in housing 90. Lever 92 is rotatable about pin 94 in housing 90 and is pinned by pin 96 to lever 86. Lever 92 is adapted for being orientated in a first position, as shown in dark lines in FIG. 1, associated with supplying power from the house power supply means 22 to well pump 12. Electric cables 98 feed electric power from switch 88 to pump 12 by means well known in the art. Switch 88 has a second position, as best shown in phantom line in FIG. 1, which is adapted for supplying emergency power from emergency power supply means 24 through the same electrical cables 98. Electric power supply means 24 is in electrical connection with switch 88 by means of cable 100. Preferably cable 100 is disposed in conduit 30.

Housing 102 covers switch 88, reel operated hydrant H and well 10, as best shown in FIG. 1. Cables 26 and 100 pas through apertures 104 and 106, respectively, in a wall 108 of housing 102 and are sealed by seals 110 and 112, respectively. Cover 114 has a handle 116 and is pivotably connected by hinge 118 to wall 108 so that cover 114 may be raised in order to access lever 76 and hose 56.

As should be obvious to one skilled in the art, lever 76, links 86,92,70, and 64, define an actuator assembly which is operably interconnected to switch 88 and valve 40 and is advantageously adapted for simultaneously positioning valve 40 and switch 88 in any one of the preselected associated first and second positions for supplying water to first fluid distribution system 14 or second fluid distribution 42. In this way, by merely operating lever 76, a homeowner or other individual may shut off power to the house distribution system D by operating lever 76 so that link or lever 92 will rotate on pin 94 from the first position shown in dark lines in FIG. 1 to the second position shown in phantom line in FIG. 1. Simultaneously, operation of lever 76 will cause link 70 to rotate lever 64 from the first position shown in dark lines in FIG. 1 to the second position shown in phantom line in FIG. 1. In this way, one may ascertain that the power in the house may be disengaged while still permitting power to be supplied to pump 12 so as to provide water to hose 56 in order to fight a fire without the possibility of short circuiting and/or electrocution in the structure S.

While this invention has been described as having a prefered design, it is understood that it is capable of further modifications, uses an/or adaptations of the invention following in general the principles of the invention and including such departures from the present disclosure as come within known or customary practice in the art to which the invention pertains, and as may be applied to the central features herin before set forth, and falls in the scope of the invention of the limits of the appended claims.

What I claim is:

1. An emergency fluid supply system in combination with a well having an electrically operable pump supplying fluid to a structure having a first fluid distribution system, electric power supply means and an electric distribution system, comprising:

(a) a second fluid distribution system in fluid communication with said pump;

(b) valve means connecting said first and second fluid distribution systems and having a first position associated with fluid supply to said first fluid distribution system and a second position associated with fluid supply to said second fluid distribution system;

(c) switch means in electrical connection with said power supply means, said pump and said electric distribution means and having a first position associated with power supply to said pump and said electric distribution system and a second position associated with power supply to said pump only;

(d) said valve means first position being associated with said switch means first position and said valve means second position being associated with said switch means second position;

(e) actuator means operably interconnecting said valve means and said switch means for simultaneously positioning said valve means and said switch means in a preselected associated one of said first and second positions;

(f) said valve means being disposed in said well;

(g) said actuator means comprises a rod connected to said valve means for positioning said valve in a preselected one of said first and second positions and said rod extending upwardly from said well;

(h) a platform disposed adjacent the upper portion of said well;

(i) a support secured to said platform;

(j) said switch means secured to said platform; and, (k) lever means pivotably secured to said support and to said switch means and said rod and adapted for simultaneously positioning said switch means and said valve means in an associated one of said first and second positions.

2. A system as defined in claim 1, wherein:

(a) said second fluid distribution system including hose means.

3. A system as defined in claim 2, wherein:

(a) said hose means being disposed on a rotatable reel means whereby said hose means is in fluid communication with said pump.

4. A system as defined in claim 1, wherein:

(a) said switch means including a three-pole switch;

(b) a first one of said poles adapted for supplying electric power to said pump;

(c) a second one of said poles being in electrical connection with said electric distribution system; and, (d) a third one of said poles being in electrical connection with said power supply means only.

5. A system as defined in claim 4, wherein:

(a) said actuator means including lever means adapted for providing electrical connection between one of said second and third poles with said first one pole.

6. A system as defined in claim 1, and comprising:

(a) a housing removably covering said second fluid distribution system.

7. A system as defind in claim 6, wherein:

(a) said housing including a portion adapted for rotational displacement.

8. A system as defined in claim 1, and wherein:

(a) a casing for said well; and, (b) said valve means disposed within said casing.

9. A system as defined in claim 8, wherein:

(a) said first fluid distribution system extending through said casing.

10. A system as defined in claim 1, wherein:

(a) electric cable means disposed in said well and connecting said pump and said switch means.

11. An emergency fluid supply system in combination with a wall having an electrically operable pump supplying fluid to a structure having a first fluid distribution system, electric power supply means and an electric distribution system, comprising:

(a) a second fluid distribution system in fluid communication with said pump;

(b) valve means connecting said first and second fluid distribution systems and having a first position associated with fluid supply to said first fluid distribution system and a second position associated with fluid supply to said second fluid distribution system;

(c) switch means in electrical connection with said electric power supply means, said pump and said electric distribution means and having a first position associated with power supply to said pump and said electric distribution system and a second position associated with power supply to said pump only;

(d) said valve means first position being associated with said switch means first position and said valve means second position being associated with said switch means second position;

(e) actuator means operably connecting said valve means and said means for simultaneously positioning said valve means and said switch in a preselected one of said first and said second positions;

(f) said valve means being disposed in said well;

(g) said actuator means comprises a rod connected to said valve means for positioning said valve in a preselected one of said first and second positions and said rod extending upwardly from said well;

(h) a platform disposed adjacent the upper portion of said well;

(i) a support secured to said platform;

(j) said switch means secured to said platform;

(k) lever means pivotably secured to said support and to said switch means and said rod and adapted for simultaneously positioning said switch means and said valve means in an associated one of said first and second positions;

(l) a lever pivotably secured to said switch means and extending therefrom and adapted for connecting one of said second and said third poles with said first pole; and, (m) a rod pivotably secured to said lever and to said lever means for operating said lever when said lever means is operated.

12. A system as defined in claim 11, wherein:

(a) said second fluid distribution system includes hose means.

13. A system as defined in claim 11 wherein:

(a) a casing disposed within said wall; and, (b) said valve means disposed within said casing.

14. A system as defined in claim 11, wherein:

(a) electric cable means disposed in said well and connecting said pump and said switch means.

* * * * *